US011168376B2

(12) United States Patent
Han et al.

(10) Patent No.: US 11,168,376 B2
(45) Date of Patent: *Nov. 9, 2021

(54) ANNEALING SEPARATOR COMPOSITION FOR ORIENTED ELECTRICAL STEEL SHEET, ORIENTED ELECTRICAL STEEL SHEET, AND METHOD FOR MANUFACTURING ORIENTED ELECTRICAL STEEL SHEET

(71) Applicant: POSCO, Pohang-si (KR)

(72) Inventors: Min Soo Han, Pohang-si (KR); Jong-Tae Park, Pohang-si (KR); Chang Soo Park, Pohang-si (KR); Yunsu Kim, Pohang-si (KR)

(73) Assignee: POSCO, Pohang-si (KR)

( * ) Notice: Subject to any disclaimer, the term of this patent is extended or adjusted under 35 U.S.C. 154(b) by 132 days.

This patent is subject to a terminal disclaimer.

(21) Appl. No.: 16/470,931

(22) PCT Filed: Dec. 20, 2017

(86) PCT No.: PCT/KR2017/015123

§ 371 (c)(1),
(2) Date: Jun. 18, 2019

(87) PCT Pub. No.: WO2018/117637

PCT Pub. Date: Jun. 28, 2018

(65) Prior Publication Data

US 2020/0095648 A1 Mar. 26, 2020

(30) Foreign Application Priority Data

Dec. 21, 2016 (KR) ..... 10-2016-0176105

(51) Int. Cl.
*C21D 9/46* (2006.01)
*C21D 8/12* (2006.01)
(Continued)

(52) U.S. Cl.
CPC ..... *C21D 9/46* (2013.01); *C21D 6/005* (2013.01); *C21D 6/008* (2013.01); *C21D 8/1222* (2013.01);
(Continued)

(58) Field of Classification Search
CPC ... C22C 2202/02; C22C 38/00; C22C 38/001; C22C 38/002; C22C 38/008;
(Continued)

(56) References Cited

U.S. PATENT DOCUMENTS 4,287,006 A * 9/1981 Hiromae ..... C23D 5/10 148/113
5,565,272 A * 10/1996 Masui ..... C21D 8/1283 428/432

FOREIGN PATENT DOCUMENTS

BE 880287 A 3/1980
CA 984106 A 2/1976
(Continued)

OTHER PUBLICATIONS

Extended European Search Report dated Aug. 20, 2019 issued in European Patent Application No. 17882711.9.
(Continued)

*Primary Examiner* — Jenny R Wu
(74) *Attorney, Agent, or Firm* — Morgan, Lewis & Bockius LLP

(57) ABSTRACT

The present invention provides an annealing separator composition for a grain-oriented electrical steel sheet, a grain-oriented electrical steel sheet and a method for manufacturing a grain-oriented electrical steel sheet. An annealing separator composition for a grain-oriented electrical steel sheet according to an embodiment of the present invention comprises: 100 parts by weight of at least one of magnesium oxide and magnesium hydroxide; 5 to 200 parts by weight of aluminum hydroxide; and 0.1 to 20 parts by weight of a boron compound.

8 Claims, 7 Drawing Sheets

(51) Int. Cl.

| | |
|---|---|
| ***C21D 6/00*** | (2006.01) |
| ***C22C 38/60*** | (2006.01) |
| ***C22C 38/02*** | (2006.01) |
| ***C22C 38/04*** | (2006.01) |
| ***C22C 38/00*** | (2006.01) |
| ***H01F 1/18*** | (2006.01) |

(52) U.S. Cl.
CPC ..... *C21D 8/1233* (2013.01); *C21D 8/1272* (2013.01); *C21D 8/1283* (2013.01); *C22C 38/001* (2013.01); *C22C 38/002* (2013.01); *C22C 38/008* (2013.01); *C22C 38/02* (2013.01); *C22C 38/04* (2013.01); *C22C 38/60* (2013.01); *H01F 1/18* (2013.01); *C22C 2202/02* (2013.01)

(58) Field of Classification Search
CPC ..... C22C 38/02; C22C 38/04; C22C 38/06; C22C 38/60; C21D 3/04; C21D 6/005; C21D 6/008; C21D 8/12; C21D 8/1222; C21D 8/1233; C21D 8/1272; C21D 8/1283; C21D 9/46; H01F 1/147; H01F 1/18
See application file for complete search history.

(56) References Cited

FOREIGN PATENT DOCUMENTS

| | | | | |
|---|---|---|---|---|
| CN | 104726796 | A | | 6/2015 |
| CN | 104884646 | A | | 9/2015 |
| JP | S55-073823 | A | | 6/1980 |
| JP | S60-174881 | A | | 9/1985 |
| JP | H07-173642 | A | | 7/1995 |
| JP | H08-165521 | A | | 6/1996 |
| JP | 2698549 | B2 | | 1/1998 |
| JP | 2706020 | B2 | | 1/1998 |
| JP | 2003253334 | A | * | 9/2003 |
| JP | 3524058 | B2 | | 4/2004 |
| JP | 4422385 | B2 | | 2/2010 |
| JP | 2014-201806 | A | | 10/2014 |
| JP | 5696404 | A | | 2/2015 |
| KR | 10-2002-0008785 | A | | 1/2002 |
| KR | 10-2006-0013178 | A | | 2/2006 |
| KR | 10-2007-0067846 | A | | 6/2007 |
| KR | 10-0762436 | B1 | | 10/2007 |
| KR | 10-0865316 | B1 | | 10/2008 |
| KR | 10-2016-0057754 | A | | 5/2016 |
| KR | 10-2016-0063244 | A | | 6/2016 |
| KR | 10-1632871 | B1 | | 6/2016 |
| WO | 2006/126660 | A1 | | 11/2006 |
| WO | 2016-085257 | A1 | | 6/2016 |

OTHER PUBLICATIONS

International Search Report and Written Opinion dated May 29, 2018 issued in International Patent Application No. PCT/KR2017/015123 (with partial English translation).

A. J. Moses, et al., "Role of phosphate coating in determining the magnetic properties of Goss-oriented silicon iron," Proc. IEE, vol. 119, No. 8, Aug. 1972, pp. 1222-1228.

H. Han, et al., "Dependence of tracer diffusion on atomic size in amorphous Ni—Zr," Physical Review B, vol. 37, No. 11, Apr. 15, 1988, pp. 6533-6535.

D. Uk Choe, et al., "Effect of pH of Aluminum Hydroxides Gel Obtained by Hydrolysis of Al2(SO4)3 Solution on Crystal Growth of α-Al2O3 Platelets," Journal of the Korean Ceramic Society, vol. 44, No. 10, pp. 562-567, 2007.

Chinese Office Action dated May 8, 2020 issued in Chinese Patent Application No. 201780079216.3.

* cited by examiner

【FIG. 1】
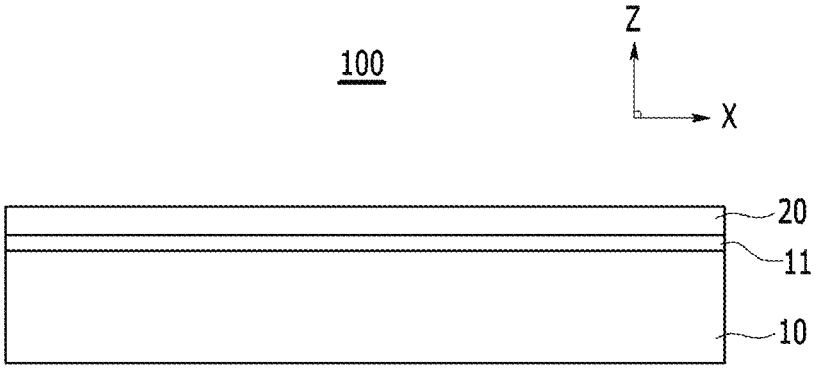
【FIG. 2a】
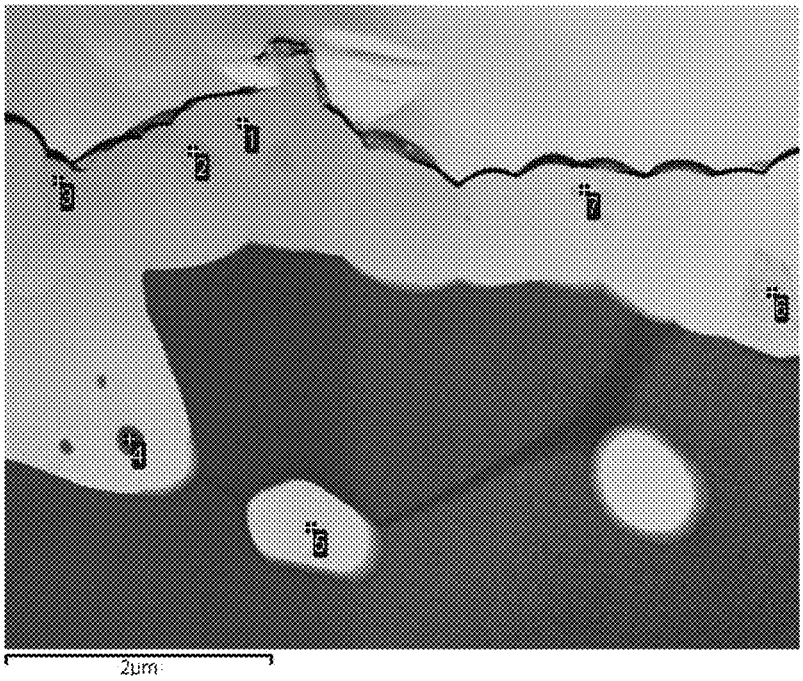

【FIG. 2b】
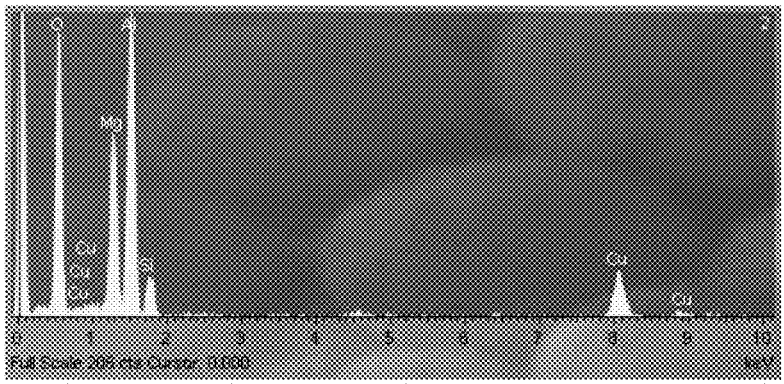
【FIG. 2c】
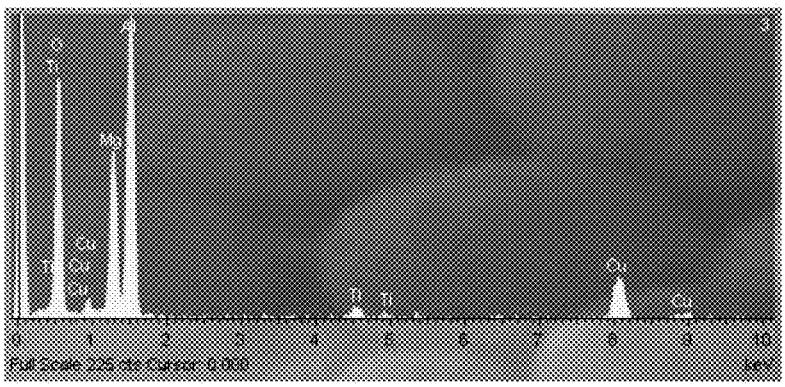

【FIG. 2d】
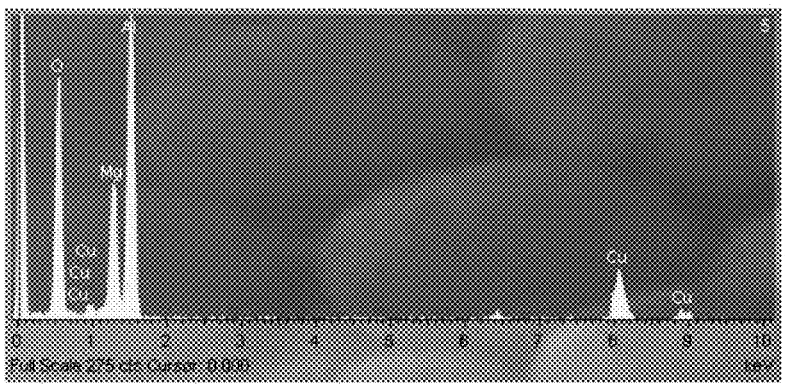
【FIG. 2e】
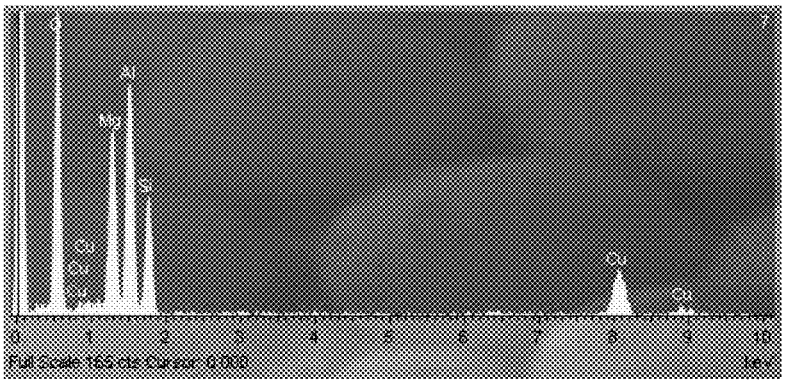

【FIG. 3】
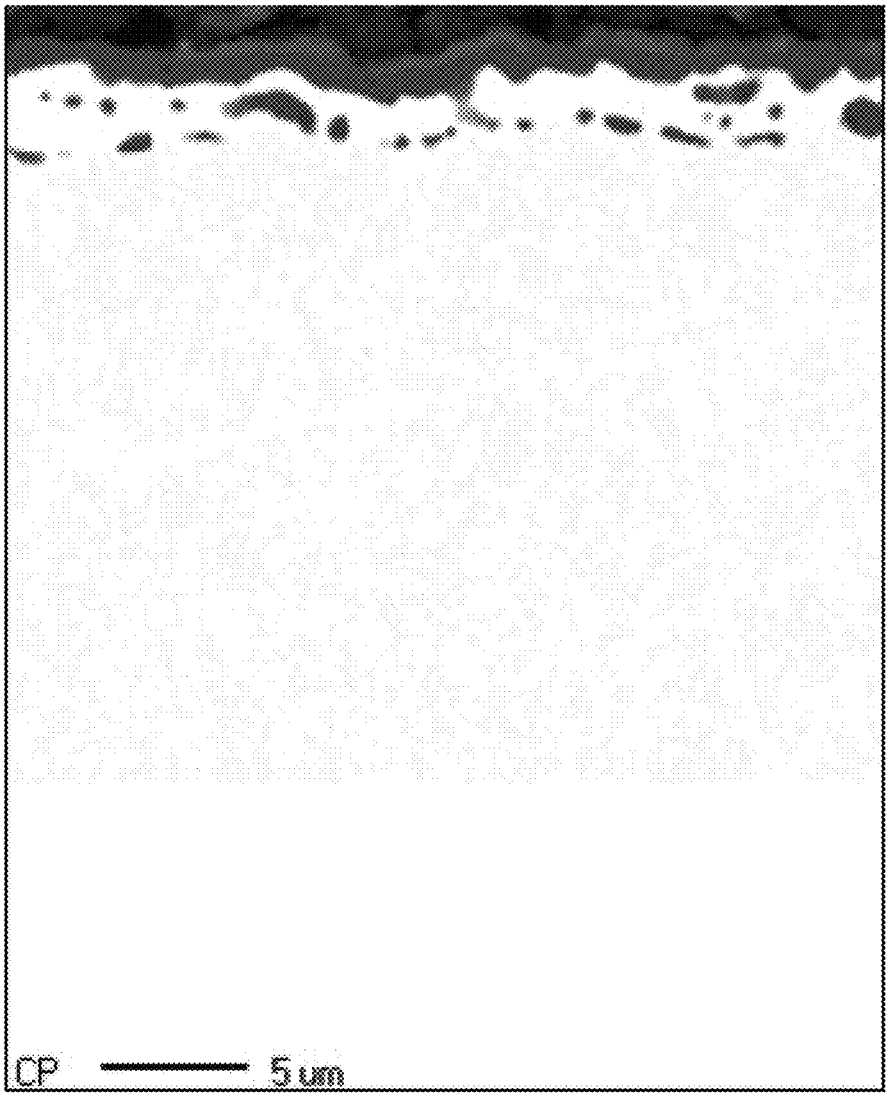

【FIG. 4】
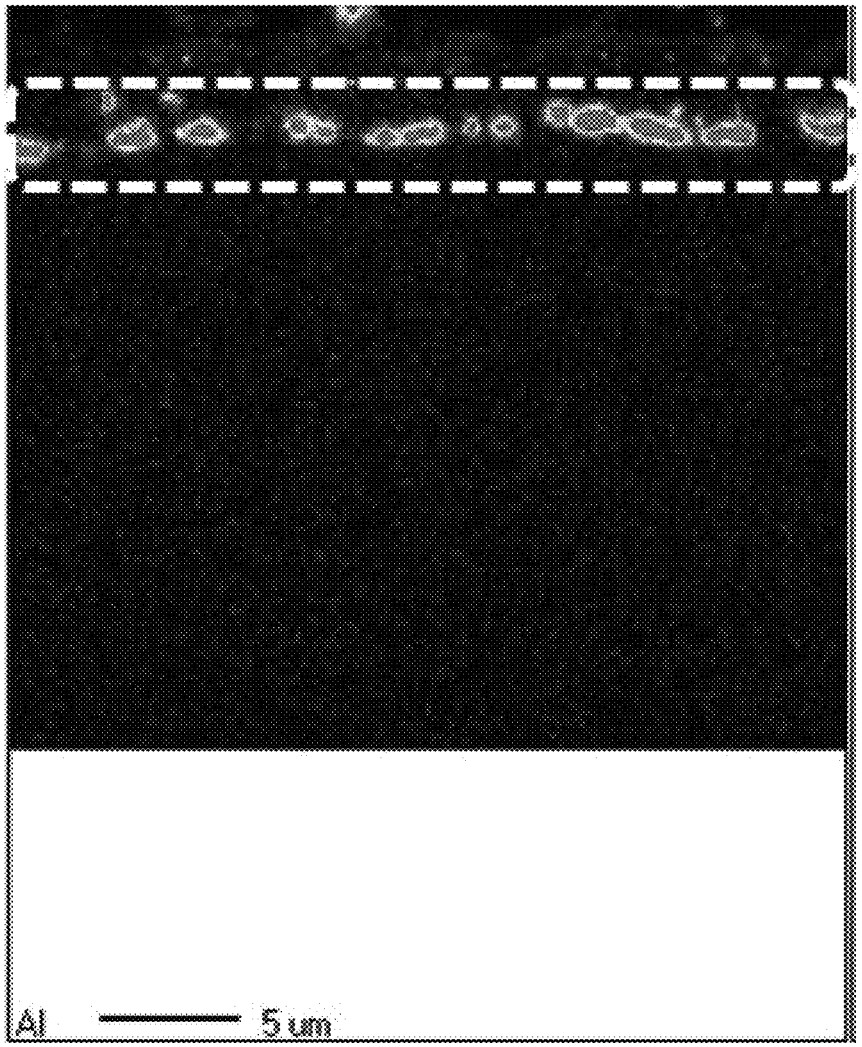

【FIG. 5】
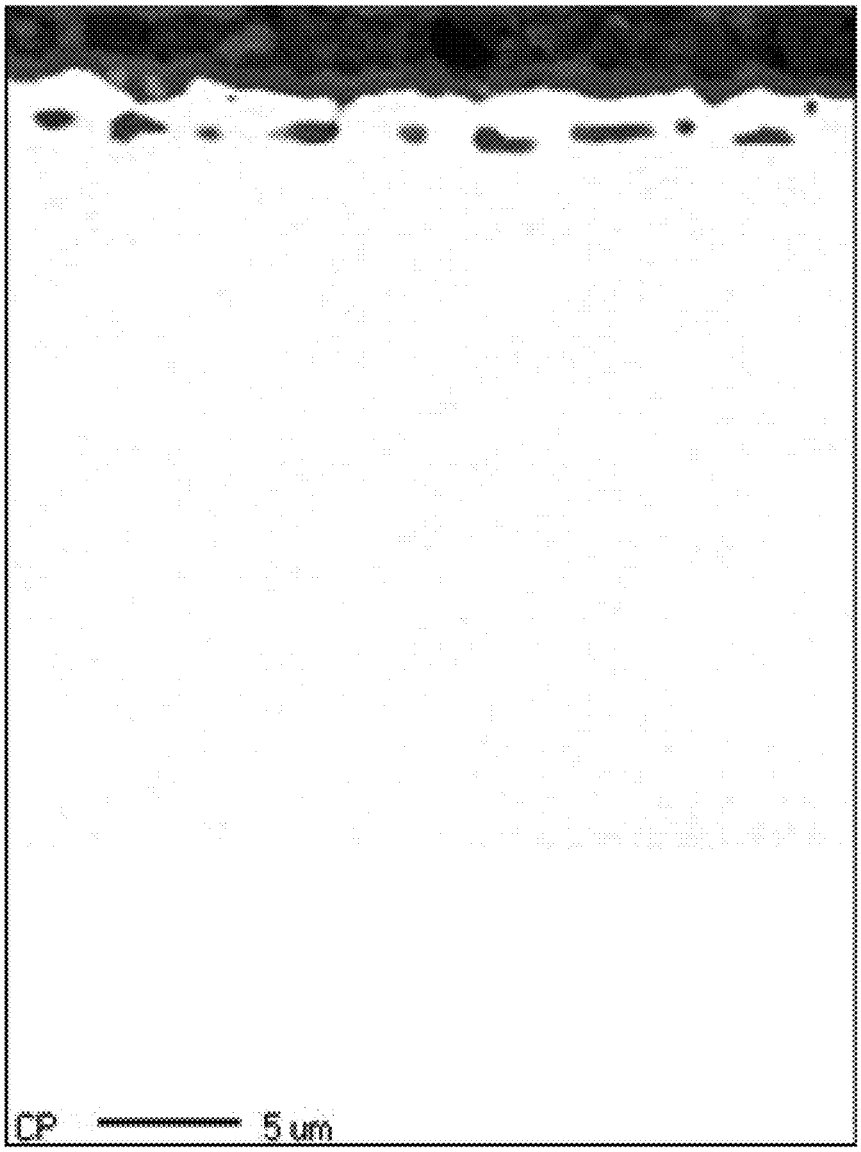

【FIG. 6】
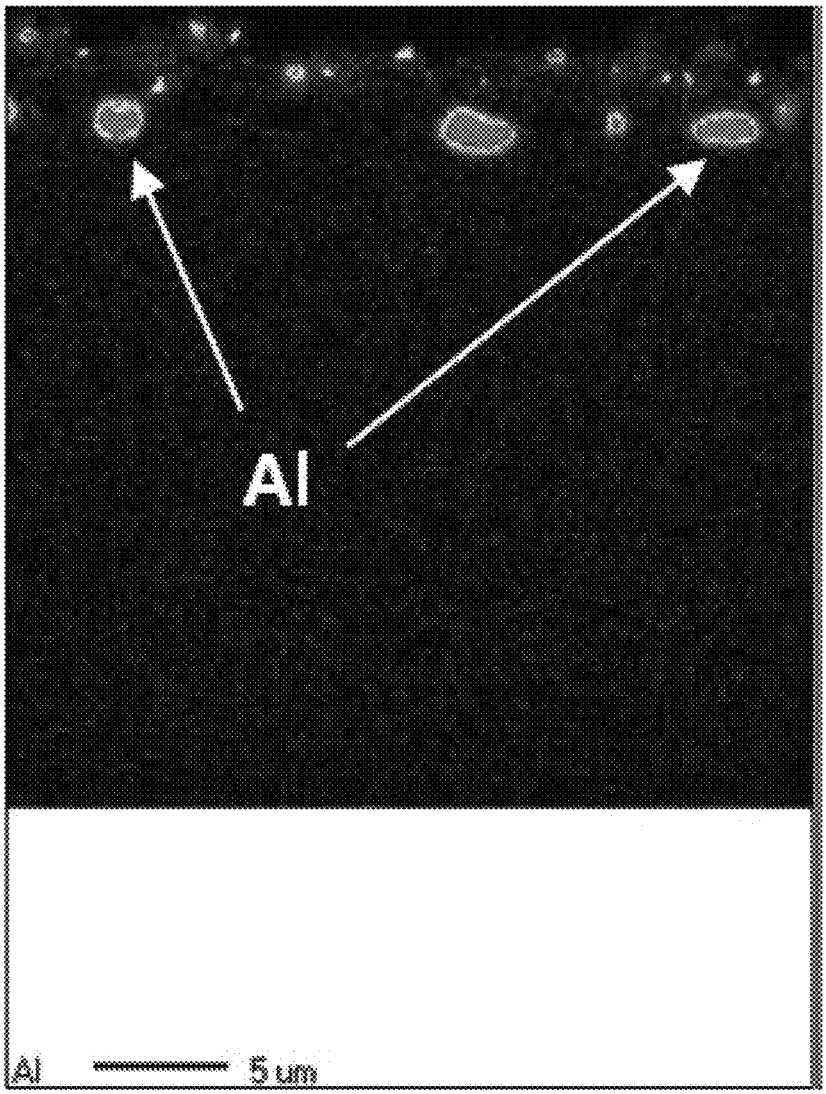

ANNEALING SEPARATOR COMPOSITION FOR ORIENTED ELECTRICAL STEEL SHEET, ORIENTED ELECTRICAL STEEL SHEET, AND METHOD FOR MANUFACTURING ORIENTED ELECTRICAL STEEL SHEET

CROSS-REFERENCE OF RELATED APPLICATIONS

This application is the U.S. National Phase under 35 U.S.C. § 371 of International Patent Application No. PCT/KR2017/015123, filed on Dec. 20, 2017, which in turn claims the benefit of Korean Application No. 10-2016-0176105, filed on Dec. 21, 2016, the entire disclosures of which applications are incorporated by reference herein.

FIELD OF THE INVENTION

The present invention relates to an annealing separator composition for a grain-oriented electrical steel sheet, a grain-oriented electrical steel sheet, and a method for manufacturing thereof.

TECHNICAL BACKGROUND OF THE INVENTION

A grain-oriented electrical steel sheet refers to an electrical steel sheet containing a Si component in a steel sheet, and having a structure of a crystalline orientation aligned in the {110}<001> directions, and having excellent magnetic properties in the rolling direction.

Recently, as grain-oriented electrical steel sheets with a high magnetic flux density have been commercialized, a material having low iron loss is required. In the case of electrical steel sheet, the iron loss improvement may be approached by four technical methods, firstly, there is a method of orienting the {110}<001> crystalline orientation comprising the easy axis of the grain-oriented electrical steel sheet precisely to the rolling direction, secondly, thinner material thickness, thirdly, a magnetic domain refinement method which refines the magnetic domain through chemical and physical methods, and lastly, improvement of surface physical property or surface tension by a chemical method such as surface treatment and coating.

Especially, with respect to the improvement of the surface physical property or surface tension, a method of forming a primary coating and an insulation coating has been proposed. As a primary coating, a forsterite ($2MgO.SiO_2$) layer consisting of a reaction of silicon oxide ($SiO_2$) produced on the surface of the material in primary recrystallization annealing process of the electric steel sheet material and magnesium oxide (MgO) used as an annealing separator is known. The primary coating formed during the high temperature annealing must have a uniform hue without defects in appearance, and functionally prevents fusion between the plates in the coil state, and may have the effect of improving the iron loss of the material by authorizing a tensile strength to the material due to the difference in thermal expansion coefficient between the material and the primary coating.

Recently, as the demand for low iron loss grain-oriented electrical steel sheet has increased, the high tension of primary coating has been sought, and in order to greatly improve the magnetic properties of the final products, the control technique of various process factors has been attempted in order to improve the property of the high tension insulation coating. Typically, the tension which is applied to the material by the primary coating, the secondary insulation, or tension coating is generally greater than 1.0 $kgf/mm^2$, and in this case, the tension specific gravity of each is approximately 50/50. Therefore, the coating tension by forsterite is about 0.5 $kgf/mm^2$, and if the coating tension by the primary coating is improved compared to the present, the transformer efficiency may be improved as well as iron loss.

In this regard, a method of introducing a halogen compound into annealing separator to obtain a coating having the high tension has been proposed. Further, a technique of forming a mullite coating having a low thermal expansion coefficient by applying an annealing separator, which the main component is kaolinite, has been proposed. Further, methods for enhancing the interfacial adhesion by introducing rare elements such as Ce, La, Pr, Nd, Sc, and Y have been proposed. However, the annealing separator additive suggested by these methods is very expensive and has a problem that the workability is considerably lowered to be applied to the actual production process. Particularly, materials such as kaolinite are insufficient in their role as an annealing separator since their poor coating property when they are manufactured from slurry for use as the annealing separator.

CONTENTS OF THE INVENTION

Problem to Solve

The present invention provides an annealing separator composition for a grain-oriented electrical steel sheet, a grain-oriented electrical steel sheet, and a method for manufacturing thereof. Specifically, the present invention provides an annealing separator composition for a grain-oriented electrical steel sheet, a grain-oriented electrical steel sheet, and a method for manufacturing thereof, which is excellent in adhesion and coating tension so that it is improving iron loss of a material.

SUMMARY OF THE INVENTION

An annealing separator composition for a grain-oriented electrical steel sheet according to an embodiment of the present invention comprises: 100 parts by weight of at least one of magnesium oxide and magnesium hydroxide; 5 to 200 parts by weight of aluminum hydroxide; and 0.1 to 20 parts by weight of a boron compound.

The boron compound may comprise at least one of boron trioxide and boric acid.

1 to 10 parts by weight of ceramic powder may be further comprised.

The ceramic powder may be at least one selected from $Al_2O_3$, $SiO_2$, $TiO_2$ and $ZrO_2$.

50 to 500 parts by weight of solvent may be further comprised.

A grain-oriented electrical steel sheet according to an embodiment of the present invention wherein a coating comprising an Al—Si—Mg composite and an Al—B compound is formed on one or both sides of a substrate of a grain-oriented electrical steel sheet.

The coating may comprise 0.1 to 40 wt % of Al, 40 to 85 wt % of Mg, 0.1 to 40 wt % of Si, 10 to 55 wt % of 0, 0.01 to 20 wt % of B and Fe as the remainder.

The coating may further comprise an Mg—Si composite, an Al—Mg composite or an Al—Si composite.

The Al—B compound may comprise at least one of $Al_4B_2O_9$ and $Al_8B_4O_{33}$.

An oxide layer may be formed from the interface between the coating and the substrate to the inside of the substrate. The oxide layer may comprise aluminum oxide and an Al—B compound.

The average particle diameter of the aluminum oxide may be 5 to 100 μm and the average particle diameter of the Al—B compound may be 1 to 10 μm, with respect to the cross-section in the thickness direction of a steel sheet.

The occupying area of the aluminum oxide and Al—B compound relative to the oxide layer area may be 0.1 to 50%, with respect to the cross-section in the thickness direction of a steel sheet.

The substrate of a grain-oriented electrical steel sheet may comprise silicon (Si): 2.0 to 7.0 wt %, aluminium (Al): 0.020 to 0.040 wt %, manganese (Mn): 0.01 to 0.20 wt %, phosphorous (P): 0.01 to 0.15 wt %, carbon (C): 0.01 wt % or less (excluding 0%), nitrogen (N): 0.005 to 0.05 wt % and 0.01 to 0.15 wt % of antimony (Sb), tin (Sn), or a combination thereof, and the remainder comprises Fe and other inevitable impurities.

A method for manufacturing a grain-oriented electrical steel sheet according to an embodiment of the present invention comprises preparing a steel slab; heating the steel slab; hot rolling the heated steel slab to produce a hot rolled sheet; cold rolling the hot rolled sheet to produce a cold rolled sheet; decarburized annealing and nitriding annealing the cold rolled sheet; applying an annealing separator on the surface of the decarburized annealed and nitriding annealed steel sheet; and high temperature annealing the steel sheet applied with the annealing separator.

The annealing separator comprises 100 parts by weight of at least one of magnesium oxide and magnesium hydroxide; 5 to 200 parts by weight of aluminum hydroxide; and 0.1 to 20 parts by weight of a boron compound.

The step of primary recrystallization annealing the cold rolled sheet may further comprise a step of simultaneously decarburized annealing and nitriding annealing the cold rolled sheet or a step of nitriding annealing after decarburized annealing.

Effect of the Invention

According to an embodiment of the present invention, a grain-oriented electrical steel sheet having excellent iron loss and flux density and excellent adhesion and insulation property of a coating, and a method for manufacturing thereof may be provided.

BRIEF DESCRIPTION OF THE DRAWINGS

FIG. 1 is a schematic side cross-sectional view of a grain-oriented electrical steel sheet according to an embodiment of the present invention.

FIGS. 2A to 2E are the result of focused ion beam-scanning electron microscope (FIB-SEM) analysis of the coating of the grain-oriented electrical steel sheet manufactured in Embodiment 5.

FIG. 3 is a scanning electron microscope (SEM) photograph of the cross section of the grain-oriented electrical steel sheet manufactured in Embodiment 5.

FIG. 4 is a result of electron probe microanalysis (EPMA) analysis of the cross section of the grain-oriented electrical steel sheet manufactured in Embodiment 5.

FIG. 5 is a scanning electron microscope (SEM) photograph of the cross section of the grain-oriented electrical steel sheet manufactured in Comparative Example.

FIG. 6 is a result of electron probe microanalysis (EPMA) analysis of the cross section of the grain-oriented electrical steel sheet manufactured in Comparative Example.

DETAILED DESCRIPTION OF THE EMBODIMENTS

The first term, second and third term, etc. are used to describe various parts, components, regions, layers and/or sections, but are not limited thereto. These terms are only used to distinguish any part, component, region, layer or section from other part, component, region, layer or section. Therefore, the first part, component, region, layer or section may be referred to as the second part, component, region, layer or section within the scope unless excluded from the scope of the present invention. The terminology used herein is only to refer specific embodiments and is not intended to be limiting of the invention.

The singular forms used herein comprise plural forms as well unless the phrases clearly indicate the opposite meaning. The meaning of the term "comprise" is to specify a particular feature, region, integer, step, operation, element and/or component, not to exclude presence or addition of other features, regions, integers, steps, operations, elements and/or components.

It will be understood that when an element such as a layer, coating, region, or substrate is referred to as being "on" another element, it can be directly on the other element or intervening elements may also be present.

In contrast, when an element is referred to as being "directly on" another element, there are no intervening elements present.

In the present invention, 1 ppm means 0.0001%. In an embodiment of the present invention, the meaning further comprising additional components means that the remainder is replaced by additional amounts of the additional components.

Although not defined differently, every term comprising technical and scientific terms used herein have the same meaning as commonly understood by those who is having ordinary knowledge of the technical field to which the present invention belongs. The commonly used predefined terms are further interpreted as having meanings consistent with the relevant technology literature and the present content and are not interpreted as ideal or very formal meanings unless otherwise defined.

Hereinafter, embodiments of the present invention will be described in detail so that those skilled in the art may easily carry out the present invention.

The present invention may, however, be implemented in several different forms and is not limited to the embodiments described herein.

An annealing separator composition for a grain-oriented electrical steel sheet according to an embodiment of the present invention comprises: 100 parts by weight of at least one of magnesium oxide (MgO) and magnesium hydroxide ($Mg(OH)_2$); 5 to 200 parts by weight of aluminum hydroxide ($Al(OH)_3$); and 0.1 to 20 parts by weight of a boron compound. The weight herein means a weight contained relative to each component.

Annealing separator composition for grain-oriented electrical steel sheet according to an embodiment of the present invention, some of which reacts with silica formed on the surface of a substrate to form a composite of Al—Si—Mg by adding aluminum hydroxide ($Al(OH)_3$), which is a reactive substance in addition to magnesium oxide (MgO) which is one of the components of the conventional annealing separator composition, and there is an effect of improving the tension by coating by diffusing some of which into an oxide layer in the substrate to improve the adhesion of coating.

Further, this effect ultimately plays a role of reducing the iron loss of the material such that high efficiency transformer with low power dissipation may be manufactured.

When the cold rolled sheet passes through a heating furnace controlled in a wet atmosphere for the primary recrystallization in the manufacturing process of the grain-oriented electrical steel sheet, Si having the highest oxygen affinity in the steel reacts with oxygen supplied from the steam in the furnace to form $SiO_2$ on the surface. Thereafter, Fe-based oxides are produced by oxygen penetration into the steel. The $SiO_2$ thus formed forms a forsterite ($Mg_2SiO_4$) layer through a chemical reaction with magnesium oxide or magnesium hydroxide in the annealing separator as shown in the following reaction Formula 1.

$$2Mg(OH)_2+SiO_2 \rightarrow Mg_2SiO_4+2H_2O \quad \text{[Reaction Formula 1]}$$

That is, the electrical steel sheet subjected to the primary recrystallization annealing is subjected to the secondary recrystallization annealing after applying the magnesium oxide slurry as an annealing separator, that is, it is subjected a high temperature annealing, at this time, the material expanded by heat tries to shrink again upon cooling but the forsterite layer which is already formed on the surface disturbs shrinkage of the material. Residual stress □$\sigma_{RD}$ in the rolling direction when the thermal expansion coefficient of forsterite coating is very small compared to the material may be expressed by the following Formula.

$$\sigma_{RD}=2E_c\delta(\alpha_{Si-Fe}-\alpha)\Delta T(1-v_{RD})$$

Wherein $\Delta T$=difference between the secondary recrystallization annealing temperature and Normal temperature (° C.), $\alpha_{Si-Fe}$=thermal expansion coefficient of material, $\alpha_C$=thermal expansion coefficient of the primary coating, $E_c$=the average value of the primary coating elasticity (Young's Modulus)

$\delta$=Thickness ratio of material and coating layer, $v_{RD}$=Poisson's ratio (Poisson's ratio) in the rolling direction From the above Formulas, the tensile strength improvement coefficient by the primary coating is the thickness of the primary coating or the difference of thermal expansion coefficient between the substrate and coating, and if the thickness of the coating is improved, the space factor becomes poor, the tensile strength may be increased by widening the thermal expansion coefficient difference between the substrate and the coating. However, since the annealing separator is limited to magnesium oxide, there is a limitation in improving improve the coating tension by widening the thermal expansion coefficient difference or increasing the primary coating elasticity (Young's Modulus) value.

In an embodiment of the present invention, an Al—Si—Mg composite is induced by introducing an aluminum-based additive which is capable of reacting with the silica which present on the surface of material to overcome the physical limitations of pure forsterite while the thermal expansion coefficient is lowered and at the same time a part of it induces improvement of adhesion by diffusing into the oxide layer and presenting at the interface between the oxide layer and the substrate.

As mentioned above, the existing primary coating is forsterite formed by the reaction of Mg—Si, and the thermal expansion coefficient is about $11\times10^{-6}$/K, and the difference with the base material does not exceed more than about 2.0. On the other hand, the Al—Si composite with low thermal expansion coefficient has mullite, and the Al—Si—Mg composite phase has Cordierite. The difference in thermal expansion coefficient between each composite and material is about 7.0 to 11.0, on the other hand, the primary coating elasticity (Young's Modulus) is slightly lower than that of conventional forsterite.

In an embodiment of the present invention, as mentioned above, a part of the aluminum-based additive reacts with the silica present on the surface of the substrate, and a part of it diffuses into the oxide layer inside the substrate to improve the coating tension while being present in the form of aluminum oxide.

Further, a born compound is added in an embodiment of the present invention. The born compound reacts with aluminum hydroxide in the coating to form an Al—B compound, and a part of the boron compound diffuses into the oxide layer inside the substrate and reacts with aluminum to form an Al—B compound. The Al—B compound thus formed lowers thermal expansion coefficient in the coating and improves the adhesion between the oxide layer and the substrate in the oxide layer.

Hereinafter, the annealing separator composition according to an embodiment of the present invention will be described in detail for each component.

In an embodiment of the present invention, the annealing separator composition comprises 100 parts by weight of at least one of magnesium oxide and magnesium hydroxide. In an embodiment of the present invention, the annealing separator composition comprise may be present in the form of a slurry to easily apply to the surface of the substrate of a grain-oriented electrical steel sheet. When the slurry comprises water as a solvent, the magnesium oxide may be easily soluble in water and may be present in the form of magnesium hydroxide. Therefore, in an embodiment of the present invention, magnesium oxide and magnesium hydroxide are treated as one component. The meaning of comprising 100 parts by weight of at least one of magnesium oxide and magnesium hydroxide is when magnesium oxide alone is comprised, 100 parts by weight of magnesium oxide is comprised, and when magnesium hydroxide is comprised alone, 100 parts by weight of magnesium hydroxide, and when magnesium oxide and magnesium hydroxide are comprised at the same time, means that the total amount thereof is 100 parts by weight.

The degree of activation of magnesium oxide may be 400 to seconds. When the degree of activation of magnesium oxide is too large, a problem of leaving a spinel oxide ($MgO.Al_2O_3$) on the surface after secondary recrystallization annealing may be aroused. When the degree of activation of magnesium oxide is too small, it may not react with the oxide layer and form a coating. Therefore, the degree of activation of magnesium oxide may be controlled within the ranges mentioned above. At this time, the degree of activation means that the ability of the MgO powder to cause a chemical reaction with other components. The degree of activation is measured by the time it takes MgO to completely neutralize a given amount of citric acid solution. When the degree of activation is high, the time required for neutralization is short, and when the degree of activation is low, on the contrary, the degree of neutralization may be high. Specifically, it is measured as the time taken for the solution to change from white to pink when 2 g of MgO is placed to 100 ml of a 0.4 N citric acid solution to which 2 ml of 1% phenolphthalein reagent is added at 30° C. and then stirred.

In an embodiment of the present invention, the annealing separator composition comprises 5 to 200 parts by weight of aluminum hydroxide. In an embodiment of the present invention, aluminum hydroxide ($Al(OH)_3$) having a reactive hydroxy group (—OH) in an aluminum component system is introduced into the annealing separator composition. In the case of aluminum hydroxide, it is applied in the form of slurry since the atomic size is small compared to magnesium oxide, and in the secondary recrystallization annealing, it diffuses to the oxide layer presenting on the surface of the material competitively with magnesium oxide. In this case, a part of it will react with silica constituting a substantial part of the oxide of the surface of material during the diffusion process and form a composite material of Al—Si form by condensation reaction is expected, and a part of it also react with oxides and form Mg—Si—Mg composite material.

Further, a part of the aluminum hydroxide permeates to the interface between the substrate and the oxide layer and is present in the form of aluminum oxide.

Such aluminum oxide ($Al_2O_3$) may specifically be α-aluminum oxide. The amorphous aluminum hydroxide is subjected phase inversion from the γ phase to the α phase mostly at about 1100° C. Therefore, in an embodiment of the present invention, reactive aluminum hydroxide ($Al(OH)_3$) is introduced into an annealing separator constituted of a magnesium oxide/magnesium hydroxide as main components, and a part forms Al—Si—Mg ternary composite with a magnesium oxide/magnesium hydroxide to lower the coefficient of thermal expansion compared to conventional Mg—Si binary forsterite coatings and at the same time, a part penetrates into the material and oxide layer interface to exist in the form of aluminum oxide while enhancing the coating elasticity and the interfacial adhesion between the substrate and the coating to maximize tension induced by the coatings.

Unlike magnesium oxide and magnesium hydroxide described above, in the case of aluminum hydroxide, it is hardly soluble in water and is not transformed into aluminum oxide ($Al_2O_3$) under conventional conditions. In the case of aluminum oxide ($Al_2O_3$), there is a problem that it is chemically very stable and most of settle in the slurry, which makes it difficult to form a homogeneous phase, and there is a difficulty in forming an Al—Mg composite or an Al—Si—Mg composite since there is no chemically activated Site. On the other hand, aluminum hydroxide has an excellent mixability in the slurry and has a chemical active phrase (—OH), which makes it easy to form an Al—Mg composite or Al—Si—Mg composite by reacting with silicon oxide or magnesium oxide/magnesium hydroxide.

The aluminum hydroxide is comprised in 5 to 200 parts by weight with respect to 100 parts by weight of at least one of magnesium oxide and magnesium hydroxide If aluminum hydroxide is comprised in too small amount, it is difficult to obtain the above mentioned effect of adding aluminum hydroxide. If too much aluminum hydroxide is comprised, the coating property of the annealing separator composition may deteriorate. Therefore, aluminum hydroxide may be comprised in the ranges mentioned above. More specifically, 10 to 100 parts by weight of aluminum hydroxide may be comprised. More specifically, 20 to 50 parts by weight of aluminum hydroxide may be comprised.

The average particle size of the aluminum hydroxide may be 5 to 100 μm. When the average particle size is too small, diffusion is mainly caused, and it may be difficult to form a composite in the form of three-phase system such as Al—Si—Mg by the reaction. When the average particle size is too large, diffusion to the substrate is difficult such that the effect of improvement the coating tension may be significantly deteriorated.

In an embodiment of the present invention, the annealing separator composition comprises 0.1 to 20 parts by weight of a boron compound with respect to 100 parts by weight of at least one of magnesium oxide and magnesium hydroxide. The boron compound may comprise at least one of boric acid trioxide ($B_2O_3$) and boric acid ($H_3BO_3$). The boron compound reacts with aluminum hydroxide in the coating to form an Al—B compound, and a part of the boron compound diffuses into the oxide layer inside the substrate and reacts with aluminum to form an Al—B compound. The Al—B compound thus formed lowers thermal expansion coefficient in the coating and improves the adhesion between the oxide layer and the substrate in the oxide layer. Ultimately, it further enhances the magnetic properties of the grain-oriented electrical steel sheet.

If the boron compound is added too little, it is difficult to sufficiently obtain the above-mentioned effect of addition of the boron compound. If too much boron compound is added, it is coagulated between boron compounds in the annealing separator and may arise a problem applying it. Therefore, the boron compound may be comprised in the ranges mentioned above. More specifically, 1 to 10 parts by weight of boron compound may be comprised.

The annealing separator composition for a grain-oriented electrical steel sheet may further comprise 1 to 10 parts by weight of ceramic powder with respect to 100 parts by weight of at least one of magnesium oxide and magnesium hydroxide. The ceramic powder may comprise at least one selected from $Al_2O_3$, $SiO_2$, $TiO_2$ and $ZrO_2$. When the ceramic powder further comprises an appropriate amount, the insulation properties of the coating may be further improved. Specifically, $TiO_2$ may be further comprised as a ceramic powder.

The annealing separator composition may further comprise a solvent for even dispersion and easy application of the solids. Water, alcohol, etc. may be used as a solvent, it may comprise 50 to 500 parts by weight, with respect to 100 parts by weight of at least one of magnesium oxide and magnesium hydroxide. As such, the annealing separator composition may be in the form of a slurry.

The grain-oriented electrical steel sheet (100) according to an embodiment of the present invention wherein a coating (20) comprising an Al—Si—Mg composite and an Al—B compound is formed on one or both sides of a substrate (10) of a grain-oriented electrical steel sheet. FIG. 1 shows a schematic side cross-sectional view of a grain-oriented electrical steel sheet according to an embodiment of the present invention. FIG. 1 shows a case where a coating (20) is formed on the upper surface of a substrate of a grain-oriented electrical steel sheet (10).

As mentioned above, in the coating (20) according to an embodiment of the present invention, an appropriate amount of magnesium oxide/magnesium hydroxide and aluminum hydroxide are added in the annealing separator composition so that it comprises an Al—Si—Mg composite and an Al—B compound. By comprising the Al—Si—Mg composite and the Al—B compound, the thermal expansion coefficient is lowered and the coating tension is improved, compared to the case where only the conventional forsterite is comprised. This has been mentioned above, so that redundant description is omitted.

The coating (20) may further comprise an Mg—Si composite, an Al—Mg composite, or an Al—Si composite in addition to the Al—Si—Mg composite and Al—B compound mentioned above.

The Al—B compound may comprise aluminum boron oxide, that is, at least one of $Al_4B_2O_9$ and $Al_8B_4O_{33}$.

The element composition in the coating (20) may comprise 0.1 to 40 wt % of Al, 40 to 85 wt % of Mg, 0.1 to 40 wt % of Si, 10 to 55 wt % of O, 0.01 to 20 wt % of B and Fe as the remainder. The above-mentioned element composition of Al, Mg, Si, Fe, and B are derived from the components in the substrate and the annealing separator components. In the case of O, it may be penetrated during the heat treatment process. It may further comprise additional impurities such as carbon (C).

The Thickness of the coating (20) may be 0.1 to 10 μm. When the thickness of the coating (20) is too small, the capacity of imparting the coating tension may be lowered, which may arise a problem of iron loss is inferior. When the thickness of the coating (20) is too large, the adhesion of the coating (20) becomes inferior, and peeling may occur. Therefore, the thickness of the coating (20) may be controlled to the ranges mentioned above. More specifically, the thickness of the coating (20) may be 0.8 to 6 μm.

As shown in FIG. 1, the oxide layer (11) may be formed from the interface of the coating (20) and the substrate (10) to the inside of the substrate (10). The oxide layer (11) is a layer comprising 0.01 to 0.2 wt % of O, which distinguishes from the remaining substrate (10) comprising less O.

As mentioned above, in an embodiment of the present invention, by adding aluminum hydroxide and boron compound into the annealing separator composition, aluminum and boron are diffused into a oxide layer (11) so that it forms aluminum oxide and an Al—B compound in the oxide layer (11). The aluminum oxide and Al—B compound improves the adhesion between the substrate (11) and the coating (20) such that it improves the tension by the coating (20). Since aluminum oxide and Al—B compound in the oxide layer (11) have already been mentioned above, redundant description will be omitted. At this time, the Al—B compound may comprise aluminum boron oxide, that is at least one of $Al_4B_2O_9$ and $Al_8B_4O_{33}$, The average particle diameter of the aluminum oxide may be 5 to 100 μm and the average particle diameter of the Al—B compound may be 1 to 10 μm, with respect to the cross-section in the thickness direction of a steel sheet. Further, the occupying area of the aluminum oxide and Al—B compound relative to the oxide layer area may be 0.1 to 50%, with respect to the cross-section in the thickness direction of a steel sheet. By distributing such a fine aluminum oxide and Al—B compound in the oxide layer (11) in a large amount, it improves the adhesion between the substrate (11) and the coating (20) such that it improves the tension by the coating (20).

In an embodiment of the present invention, the effects of the annealing separator composition and coating (20) are shown regardless of the component of the substrate of a grain-oriented electrical steel sheet (10). Supplementally, the components of the substrate of a grain-oriented electrical steel sheet (10) will be described as follows. the substrate of a grain-oriented electrical steel sheet may comprise silicon (Si): 2.0 to 7.0 wt %, aluminium (Al): 0.020 to 0.040 wt %, manganese (Mn): 0.01 to 0.20 wt %, phosphorous (P): 0.01 to 0.15 wt %, carbon (C): 0.01 wt % or less (excluding 0%), nitrogen (N): 0.005 to 0.05 wt % and 0.01 to 0.15 wt % of antimony (Sb), tin (Sn), or a combination thereof, and the remainder comprises Fe and other inevitable impurities. The description of each component of the substrate of a grain-oriented electrical steel sheet (10) is the same as that generally known, a detailed description thereof will be omitted.

A method for manufacturing a grain-oriented electrical steel sheet according to an embodiment of the present invention comprises preparing a steel slab; heating the steel slab; hot rolling the heated steel slab to produce a hot rolled sheet; cold rolling the hot rolled sheet to produce a cold rolled sheet; primary recrystallization annealing the cold rolled sheet; applying an annealing separator to the surface of the primary recrystallization annealed steel sheet; and secondary recrystallization annealing the steel sheet applied with the annealing separator thereto. In addition, the method for manufacturing the grain-oriented electrical steel sheet may further comprise other steps.

First, in step S10, a steel slab is prepared. Since the components of the steel slab are described in detail with respect to the components of the grain-oriented electrical steel sheet described above, repeated description is omitted. Next, the steel slab is heated.

At this time, the slab heating may be performed by the low-temperature slab method at 1,200° C. or less.

Next, the heated steel slab is hot rolled to produce a hot rolled sheet. Thereafter, the produced hot rolled sheet may be hot rolled annealed.

Next, the hot rolled sheet is cold rolled to produce a cold rolled sheet.

In the step of producing the cold rolled sheet, cold rolling may be performed once, or cold rolling comprising intermediate annealing may be performed twice or more.

Next, the cold rolled sheet is primary recrystallization annealed. In the step of primary recrystallization annealing process may comprise a step of simultaneously decarburized annealing and nitriding annealing the cold rolled sheet or comprises a step of nitriding annealing after decarburized annealing.

Next, the annealing separator is applied to the surface of the primary recrystallization annealed steel sheet. Since the annealing separator has been described above in detail, repeated description is omitted.

The application amount of the annealing separator may be 6 to 20 g/m$^2$. When the application amount of the annealing separator is too small, the coating formation may not be smoothly performed. When the application amount of the annealing separator is too large, it may affect the secondary recrystallization. Therefore, the application amount of the annealing separator may be adjusted in the ranges mentioned above.

It may further comprise the step of drying, after applying the annealing separator. The drying temperature may be from 300 to 700° C. When the temperature is too low, the annealing separator may not be easily dried. When the temperature is too high, it may affect secondary recrystallization. Therefore, the drying temperature of the annealing separator may be controlled to the ranges mentioned above.

Next, the steel sheet applied with the annealing separator is subjected to secondary recrystallization annealing. The coating (20) comprising forsterite of Mg—Si, a composite of Al—Si, Al—Mg and Al—B compound as shown in Formula 1 is formed on the outermost surface by the annealing separator component and the silica reaction during the secondary recrystallization annealing. Further, oxygen, aluminum, and boron penetrate into the substrate (10) and form an oxide layer (11).

The secondary recrystallization annealing is carried out at a heating rate of 18 to 75° C./hr in a temperature range of 700 to 950° C., and at a heating rate of 10 to 15° C./hr in a temperature range of 950 to 1200° C. The coating (20) may be smoothly formed by controlling the heating rate in the ranges mentioned above. Further, the temperature-raising process at 700 to 1200° C. may be carried out in an atmosphere comprising 20 to 30 vol % of nitrogen and 70 to 80 vol % of hydrogen, and after reaching 1200° C. in an atmosphere comprising 100 vol % of hydrogen. The coating (20) may be smoothly formed by controlling the atmosphere in the ranges mentioned above.

Hereinafter, the present invention will be described in more detail with reference to examples. However, these examples are only for illustrating the present invention, and the present invention is not limited thereto.

EXAMPLE

A steel slab comprising Si: 3.2%, C: 0.055%, Mn: 0.12%, Al: 0.026%, N: 0.0042%, S: 0.0045%, Sn: 0.04%, Sb: 0.03%, P: 0.03% by weight with the remainder comprising Fe and other inevitable impurities was prepared.

The slab was heated at 1150° C. for 220 minutes and then hot-rolled to a thickness of 2.8 mm to prepare a hot rolled sheet.

The hot rolled sheet was heated to 1120° C., maintained at 920° C. for 95 seconds, and then quenched in water and pickled, followed by cold rolling to a thickness of 0.23 mm to prepare a cold rolled sheet.

The cold rolled sheet was placed in a furnace which is maintained at 875° C., and then maintained for 180 seconds in a mixed atmosphere of 74 vol % of hydrogen, 25 vol % of nitrogen and 1 vol % of dry ammonia gas, and being subjected decarburization and nitriding treatment simultaneously.

As the annealing separator composition, an annealing separator was prepared by mixing 100 g of magnesium oxide having an activativity of 500 seconds, a solid phase mixture consisting of aluminum hydroxide and boron trioxide in an amount listed in Table 1 and 5 g of titanium oxide, and 400 g of water. 10 g/m$^2$ of the annealing separator was applied and secondary recrystallization annealing was performed in a type of a coil. The first soaking temperature and the second soaking temperature were set to 700° C. and 1200° C., respectively in the secondary recrystallization annealing. In the heating section, the heating condition was set to 45° C./hr at a temperature section of 700° C. to 950° C. and 15° C./hr at a temperature section of 950° C. to 1200° C.

Meanwhile, the soaking was performed in which the soaking time was set to 15 hours at 1200° C. The secondary recrystallization annealing was performed at a mixed atmosphere of 25 vol % nitrogen and 75 vol % hydrogen up to 1200° C., and after reaching 1200° C., the sheet was maintained at an atmosphere of 100 vol % hydrogen. Then, the sheet was cooled in the furnace.

Table 1 summarizes the components of the annealing separator applied to the present invention. Table 2 summarizes the tension, adhesion, iron loss, magnetic flux density, and rate of iron loss improvement after the annealing separator prepared as shown in Table 1 was applied to the specimen and subjected to secondary recrystallization annealing.

In addition, the coating tension is obtained by measuring the radius of curvature (H) of the specimen generated after removing the coating on one side of the specimen coated on both sides, and then substituting the value into the following equation.

$$\delta_{Exp} = \frac{E_c}{1 - \nu_{RD}} \times \frac{T^2}{3t} \times \frac{2H}{l^2}$$

$E_c$=Young's Modulus of the coating layer
$\nu_{RD}$=Poisson's ratio in the rolling direction
T: Thickness before coating
t: Thickness after coating
l: Length of specimen
H: Radius of curvature Further, the adhesion is represented by the minimum arc diameter without peeling of the coating when the specimen is bent by 180° in contact with the arc of 10 to 100 mm. The iron loss and magnetic flux density were measured by single sheet measurement method, the iron loss ($W_{17/50}$) means the power loss represented when magnetizing a magnetic field of frequency 50 Hz to 1.7 tesla by AC. The magnetic flux density ($B_8$) means a flux density value flowing an electrical steel sheet when a current of 800 A/m was flowed through a winding wound around an electrical steel sheet.

The iron loss improvement was calculated on the basis of the comparative example using the MgO annealing separator ((iron loss of comparative example−iron loss of example)/iron loss of comparative example)×100.

TABLE 1

| Specimen No. | Magnesium Oxide (g) | Aluminum Hydroxide (g) | Boron Trioxide (g) | Titanium Oxide (g) | Pure Water (g) | Remarks |
|---|---|---|---|---|---|---|
| 1 | 100 | 10 | 0.5 | 5 | 400 | Example 1 |
| 2 | 100 | 50 | 0.5 | 5 | 400 | Example 2 |
| 3 | 100 | 150 | 0.5 | 5 | 400 | Example 3 |
| 4 | 100 | 10 | 2 | 5 | 400 | Example 4 |
| 5 | 100 | 50 | 2 | 5 | 400 | Example 5 |
| 6 | 100 | 150 | 2 | 5 | 400 | Example 6 |
| 7 | 100 | 10 | 10 | 5 | 400 | Example 7 |
| 8 | 100 | 50 | 10 | 5 | 400 | Example 8 |
| 9 | 100 | 150 | 10 | 5 | 400 | Example 9 |
| 10 | 100 | 10 | 15 | 5 | 400 | Example 10 |
| 11 | 100 | 50 | 15 | 5 | 400 | Example 11 |
| 12 | 100 | 150 | 15 | 5 | 400 | Example 12 |
| 13 | 100 | — | — | 5 | 250 | Comparative Example |

TABLE 2

| Specimen No. | Coating Tension (kgf/mm$^2$) | Adhesion (mmϕ) | Magnetic Properties: Iron Loss ($W_{17/50}$, W/kg) | Magnetic Properties: Improvement (%) | Magnetic Properties: Magnetic Flux Density ($B_8$, T) | Remarks |
|---|---|---|---|---|---|---|
| 1 | 0.45 | 25 | 0.94 | 1.1 | 1.91 | Example 1 |
| 2 | 0.43 | 25 | 0.95 | 0.0 | 1.91 | Example 2 |
| 3 | 0.46 | 25 | 0.93 | 2.1 | 1.91 | Example 3 |
| 4 | 0.85 | 25 | 0.88 | 7.4 | 1.91 | Example 4 |
| 5 | 1.03 | 20 | 0.86 | 9.5 | 1.92 | Example 5 |
| 6 | 0.95 | 20 | 0.85 | 10.5 | 1.93 | Example 6 |
| 7 | 0.92 | 20 | 0.89 | 6.3 | 1.93 | Example 7 |
| 8 | 1.01 | 20 | 0.83 | 12.6 | 1.93 | Example 8 |
| 9 | 0.99 | 15 | 0.84 | 11.6 | 1.94 | Example 9 |
| 10 | 0.93 | 15 | 0.92 | 3.2 | 1.94 | Example 10 |
| 11 | 0.94 | 20 | 0.91 | 4.2 | 1.93 | Example 11 |
| 12 | 0.91 | 20 | 0.92 | 3.2 | 1.93 | Example 12 |
| 13 | 0.40 | 25 | 0.95 | — | 1.90 | Comparative Example |

As shown in Table 1 and Table 2, when aluminum hydroxide and boron trioxide were added to the annealing separator, the coating tension was improved and the magnetic properties were ultimately improved as compared with the case without addition of hydroxide and boron trioxide FIG. 2*a* to FIG. 2*e* show results of focused ion beam-scanning electron microscopy (FIB-SEM) analysis of the coating of the grain-oriented electrical steel sheet manufactured in Example 5.

FIGS. 2*b*, 2*c*, 2*d*, and 2*e* are the analysis results at positions 2, 3, 6, and 7 in FIG. 2*a*, respectively.

As shown in FIG. 2, cross sections which are seen as aluminum complexes are identified in the middle of the coating. As a result, it may be confirmed that aluminum hydroxide added in the annealing separator makes Al—Si—Mg ternary composite material to serve to lower the coefficient of thermal expansion along with magnesium oxide, compared with that of the conventional forsterite coating, thereby ultimately improving the magnetic properties.

FIG. 3 and FIG. 4 show scanning electron microscope (SEM) photographs and electron probe microanalysis (EPMA) analysis results of the cross-section of the grain-oriented electrical steel sheet manufactured in Example 5. FIG. 5 and FIG. 6 show scanning electron microscope (SEM) photographs and electron probe microanalysis (EPMA) analysis results of the cross-section of the grain-oriented electrical steel sheet manufactured in the comparative example.

As shown in FIG. 3 and FIG. 4, when aluminum hydroxide and boron trioxide are added, it may be confirmed that aluminum atoms are distributed in a large amount in the oxide layer (layer between white dotted lines) in the form of aluminum oxide and aluminum boron oxide. It may be understood that aluminum hydroxide and aluminum boron oxide added in the annealing separator are formed by penetrating into the inside of the substrate. In Example 5, it may be confirmed that the average particle sizes of aluminum oxide and aluminum boron oxide were 50 μm and 10 μm, respectively, and the area fraction was 5%.

On the other hand, as shown in FIG. 5 and FIG. 6, it may be confirmed that aluminum oxide is partially present even when aluminum hydroxide is not added to the annealing separator. It may be confirmed that this is derived from aluminum comprised in the substrate itself, and a relatively small amount of aluminum atoms are distributed.

The present invention is not limited to the above-mentioned examples or embodiments and may be manufactured in various forms, those who have ordinary knowledge of the technical field to which the present invention belongs may understand that it may be carried out in different and concrete forms without changing the technical idea or fundamental feature of the present invention. Therefore, the above-mentioned examples or embodiments are illustrative in all aspects and not limitative.

| [Explanation of symbols] | |
|---|---|
| 100: Grain-oriented electrical steel sheet | 10: Substrate of a grain-oriented electrical steel sheet |
| 11: Oxide layer | 20: Coating |

What is claimed is:

1. A grain-oriented electrical steel sheet wherein a coating comprising an Al—Si—Mg composite and an Al—B compound is formed on one or both sides of a substrate of a grain-oriented electrical steel sheet, wherein an oxide layer is formed from the interface between the coating and the substrate to the inside of the substrate, wherein the oxide layer comprises aluminum oxide and an Al—B compound, and wherein an occupying area of the aluminum oxide and Al—B compound relative to the oxide layer area is 0.1 to 50%, with respect to the cross-section in the thickness direction of the steel sheet.

2. The grain-oriented electrical steel sheet of claim 1, wherein the coating comprises 0.1 to 40 wt % of Al, 40 to 85 wt % of Mg, 0.1 to 40 wt % of Si, 10 to 55 wt % of O, 0.01 to 20 wt % of B and Fe as the remainder.

3. The grain-oriented electrical steel sheet of claim 1, wherein the coating further comprises an Mg—Si composite, an Al—Mg composite or an Al—Si composite.

4. The grain-oriented electrical steel sheet of claim 1, wherein the Al—B compound comprises at least one of $Al_4B_2O_9$ and $Al_8B_4O_{33}$.

5. The grain-oriented electrical steel sheet of claim 1, wherein the average particle diameter of the aluminum oxide is 5 to 100 μm and the average particle diameter of the Al—B compound is 1 to 10 μm, with respect to the cross-section in the thickness direction of a steel sheet.

6. The grain-oriented electrical steel sheet of claim 1, wherein the substrate of a grain-oriented electrical steel sheet comprises silicon (Si): 2.0 to 7.0 wt %, aluminium (Al): 0.020 to 0.040 wt %, manganese (Mn): 0.01 to 0.20 wt %, phosphorous (P): 0.01 to 0.15 wt %, carbon (C): 0.01 wt % or less (excluding 0%), nitrogen (N): 0.005 to 0.05 wt % and 0.01 to 0.15 wt % of antimony (Sb), tin (Sn), or a combination thereof, and the remainder comprises Fe and other inevitable impurities.

7. A method for manufacturing a grain-oriented electrical steel sheet of claim 1 comprising:

preparing a steel slab; heating the steel slab;

hot rolling the heated steel slab to produce a hot rolled sheet; cold rolling the hot rolled sheet to produce a cold rolled sheet; primary recrystallization annealing the cold rolled sheet;

applying an annealing separator to the surface of the primary recrystallization annealed steel sheet; and secondary recrystallization annealing the steel sheet applied with the annealing separator thereto, thereby producing the grain-oriented electrical steel sheet of claim 1, wherein the annealing separator comprises 100 parts by weight of at least one of magnesium oxide and magnesium hydroxide; 5 to 200 parts by weight of aluminum hydroxide; and 0.1 to 20 parts by weight of a boron compound.

8. The method of claim 7, wherein the step of primary recrystallization annealing the cold rolled sheet comprises a step of simultaneously decarburized annealing and nitriding annealing the cold rolled sheet or a step of nitriding annealing after decarburized annealing.

* * * * *